United States Patent [19]

Hertsgaard et al.

[11] Patent Number: 4,714,020

[45] Date of Patent: Dec. 22, 1987

[54] ENABLING DEVICE FOR A GAS GENERATOR OF A FORCED DISPERSION MUNITIONS DISPENSER

[75] Inventors: John P. Hertsgaard, Minneapolis; W. Keith Gallant, Plymouth, both of Minn.

[73] Assignee: Honeywell Inc., Minneapolis, Minn.

[21] Appl. No.: 8,692

[22] Filed: Jan. 30, 1987

[51] Int. Cl.[4] ..... F42B 4/06

[52] U.S. Cl. ..... 102/351; 102/275.11; 102/478; 102/289; 102/481; 102/377; 102/489; 102/380; 102/506

[58] Field of Search ..... 102/374, 376, 377, 378, 102/380, 478, 481, 489, 506, 286, 287, 289, 349, 350, 351, 506, 275.6, 275.11

[56] References Cited

U.S. PATENT DOCUMENTS

| | | | |
|---|---|---|---|
| 3,173,364 | 3/1965 | Nordzell | 102/481 |
| 3,730,098 | 5/1973 | Edwards | 102/378 X |
| 3,865,035 | 2/1975 | Munson et al. | 102/481 X |
| 4,158,334 | 6/1979 | Osburn | 102/428 X |
| 4,202,271 | 5/1980 | Day | 102/247 |
| 4,281,600 | 8/1981 | Arnell | 102/489 |
| 4,333,402 | 6/1982 | Landstrom et al. | 102/351 X |
| 4,372,216 | 2/1983 | Pinson et al. | 102/489 |
| 4,406,227 | 9/1983 | Beeker et al. | 102/351 X |
| 4,557,198 | 12/1985 | Hickey | 102/481 |

*Primary Examiner*—Peter A. Nelson
*Attorney, Agent, or Firm*—Roger W. Jensen

[57] ABSTRACT

An enabling device 24 for a gas generator 42 of a forced dispersion munitions dispenser 10 includes a housing 58 in which and formed a bore 60, an outlet lead 88 and a detonator opening 68 in which is positioned an electrically initiated detonator 70. A piston 62 is located in the bore 60 and has a disabled position and an enabled position. A safety groove 64 is formed in the outer surface of the piston 62, and a safety passage 72, a safety aperture 74, 75 and a transfer lead 86 are formed in the piston 62. A gas generator 42 containing a quantity of pyrotechnic material 84 is mounted on the housing 58. The gas generator 42 is provided with a safety outlet 46, 47 and an inlet lead 44. When the piston 62 is in its disabled position, the safety groove 64 and the bore 60 in the housing 58 provide a path by which the products created by the detonator 70 being initiated are vented from the housing 58; and the safety passage 72, safety opening 76, 77 and safety outlet 46, 47 of the gas generator 42 and the bore 60 of the housing 58 provide a path by which gas produced by the gas generator 42 is vented from the housing 58. When the piston 62 is in its enabled position a firing train from the detonator 70 to the pyrotechnic material 84 is aligned. The firing train includes the transfer lead 86 of the piston 62, the output lead 88 of the housing 58, and the inlet lead 44 of the gas generator 42. Initiating the detonator 70 will, ignite the pyrotechnic material 84 of the gas generator 42. The piston 62 in its enabled position, closes the safety outlet 46, 47 of the gas generator 42.

20 Claims, 6 Drawing Figures

ENABLING DEVICE FOR A GAS GENERATOR OF A FORCED DISPERSION MUNITIONS DISPENSER

BACKGROUND OF THE INVENTION

1. Field of the Invention

This invention is in the field of munition dispensers and more particularly relates to enabling devices for gas generators of forced dispersion dispensers of submunitions.

2. Description of the Prior Art

Munitions dispersers that forcefully eject submunitions from a carrier dispenser have been developed. These forced dispersion dispensers eject their submunitions by applying a force to the individual submunitions to expel them laterally from the dispensers. This force is typically generated by igniting a pyrotechnic powder grain of a gas generator to rapidly produce a sufficient volume of gas to inflate a bladder, or air bag, positioned between the gas generator and the submunitions.

When forced dispersion system are incorporated into munitions dispensers, safety issues are created because an inadvertent function of the forced dispersion system caused by high temperatures, strong electrical currents, vibrations, explosive self-initiation, etc., could rupture the skin, or outer envelope, of the dispenser, and forcefully expel the submunitions from the carrier. Such an occurrence would constitute a serious threat to personnel assembling, transporting or mounting a disperser on an aircraft as well as to equipment, ground vehicles, and airplanes, in the vicinity of a malfunctioning munitions disperser.

SUMMARY OF THE INVENTION

The present invention provides an enabling device for the gas generator of a forced dispersion dispenser, or disperser. The enabling device has two states, a disabled state and an enabled state. In its disabled state, the enabling device provides a safety vent, or passage, so that if the detonator of the enabling device misfires or functions for any reason, the flames and hot gases produced by the detonator are vented outside the enabling device, and, thus, will not ignite the grain or grains of pyrotechnic material of the gas generator with which the enabling device is associated.

When the enabling device is in its disabled state, safety passages from the gas generator through the enabling device are provided so that if the pyrotechnic material of the gas generator becomes ignited for any reason, the gases produced by the burning pyrotechnic material are vented through the safety passages of the enabling device so that the force applied to the submunitions is well below that which would be necessary to expel the submunitions from the dispenser while its outer skin or envelope remains intact.

The enabling device includes a movable barrier, or piston. When the piston is in its disabled position, a safety vent groove formed on the periphery of the piston vents the output of an exploding detonator away from the gas generator. A safety passage within the piston permits any gases produced by the gas generator to escape from the enabling device. In its enabled position, a transfer lead formed through the piston completes a firing train from the detonator of the enabling device to the pyrotechnic material of the gas generator. When the piston is in its enabled position, the piston blocks the safety vent and safety passages provided by the piston when in its disabled position. A mechanism is provided to drive the piston from its disabled to its enabled position only after the outer envelope of the dispenser has been removed.

It is therefore an object of this invention to provide an enabling device for a gas generator of a forced dispersion dispenser for submunitions which in its disabled condition prevents malfunctions of the detonator of the enabling device or of the gas generator or of both from forcefully dispersing its submunitions.

It is yet another object of this invention to provide an enabling device for a gas generator of a forced dispersion dispenser of submunitions which in its disabled condition provides a safety vent for the detonator and a safety passage for the gas generator so that the inadvertent function of either or both will not discharge the submunitions from the dispenser.

BRIEF DESCRIPTION OF THE DRAWINGS

Other objects, features and advantages of the invention will be readily apparent from the following description of certain preferred embodiments thereof, taken in conjunction with the accompanying drawings, although variations and modifications may be affected without departing from the spirit and scope of the novel concepts of the disclosure and in which.

DESCRIPTION OF THE INVENTION

Figure 1:
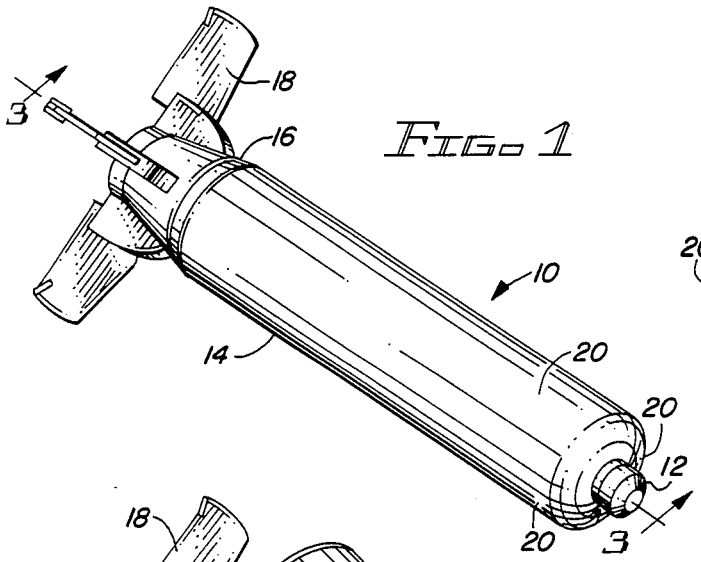
FIG. 1 is a perspective view of a tactical munitions dispenser.
Figure 2:
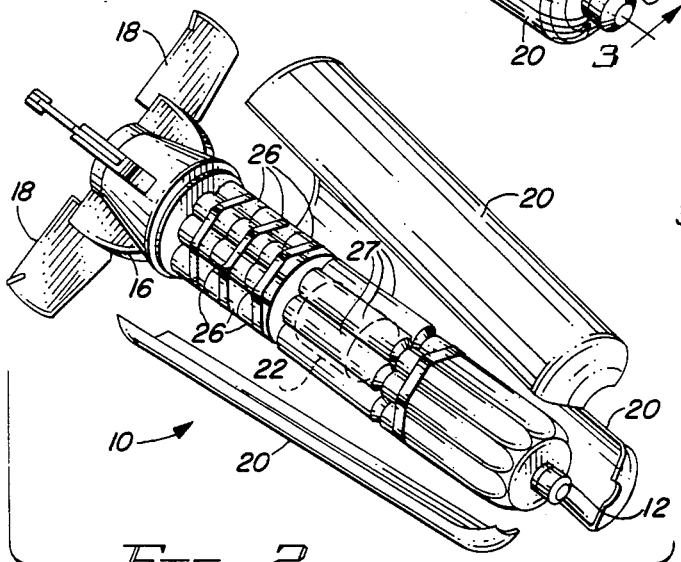
FIG. 2 is an elevation of the tactical munitions dispenser of FIG. 1 with the outer envelope being broken away to show various features of the present invention.

In FIGS. 1 and 2, tactical munitions dispenser (TMD) 10 includes a nose section 12 which includes the fuzing subsystem for TMD 10, a substantially cylindrical submunitions carrier, or carrier dispenser, or disperser, 14 and a tail section 16 which includes a plurality of stabilizer fins 18. Carrier dispenser 14 is provided with an outer skin, or envelope 20. Within envelope 20 there is located an electronic control unit (ECU) 22. Enabling device 24 is assembled with ECU 22. Also illustrated in FIG. 2 is one arrangement for positioning submunitions, such as bomblets 26 within the lower, or aft, portion of carrier 14 and boosted kinetic energy penetrators 27 in the forward portion.

Figure 3:
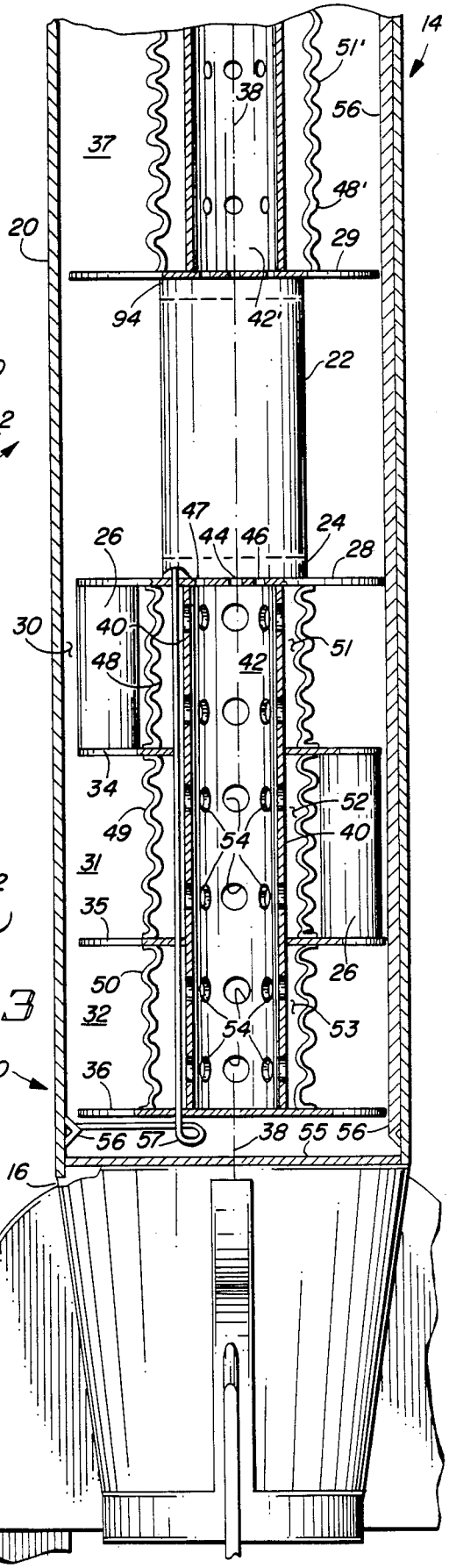
FIG. 3 is an enlarged fragmentary sectional view of the aft section of the dispenser taken on line 3—3 of FIG. 1.

In FIG. 3, ECU 22 is illustrated as being secured between bulkhead 28 and bulkhead 29 of carrier 14. A portion of carrier 14, aft of bulkhead 28 is divided into three submunitions bays 30, 31 and 32 by intermediate bulkheads 34, 35 and aft bulkhead 36. That portion of carrier 14 forward of bulkhead 29 forms a single submunitions bay 37. Outer cylinder 40 of gas generator 42 is located between bulkheads 28 and 36. Cylinder 40 is secured to bulkheads 28 and 36 which form the upper and lower ends of gas generator 42, and is positioned so as to be substantially symmetric with respect to the longitudinal axis 38 of carrier 14. The pyrotechnic material, or grains, of gas generator 42 are not illustrated in FIG. 2. An inlet lead 44 and a pair of safety outlets 46, 47 are formed through bulkhead 28, to provide communications with the interior space of gas generator 42.

Flexible membranes 48, 49 and 50 are secured between adjacent surfaces of the bulkheads forming bays 30, 31 and 32 to form expandable bladders, or air bags, 51, 52 and 53 which are inflated, or expanded, by gas produced by gas generator 42. A large number of openings 54 are formed through cylinder 40 so that gas under pressure produced by gas generator 42 will flow into air bags 51, 52 and 53 to expand them when safety outlets 46, 47 of gas generator 42 are blocked by enabling device 24 as will be explained below.

Aft end portion 55 of carrier 14 provides the necessary structure to which the tail section 16 of TMD 10 is attached. Prior to dispersing submunitions 26 and 27, the outer envelope, or skin, 20 of carrier 14 is removed, or separated by an explosive cutting network which includes shaped charges 56, one portion of the network is located around the aft perimeter of envelope 20. The network also includes additional strips of shaped charges 56 which run the length of carrier 14, only one of which is illustrated in FIG. 3. In the preferred embodiment a conventional explosive link 57 is provided between shaped charge 56 located at the aft end of carrier 14 and enabling device 24 to initiate enabling device 24 into changing from its disabled state to its enabled state.

Figure 4:
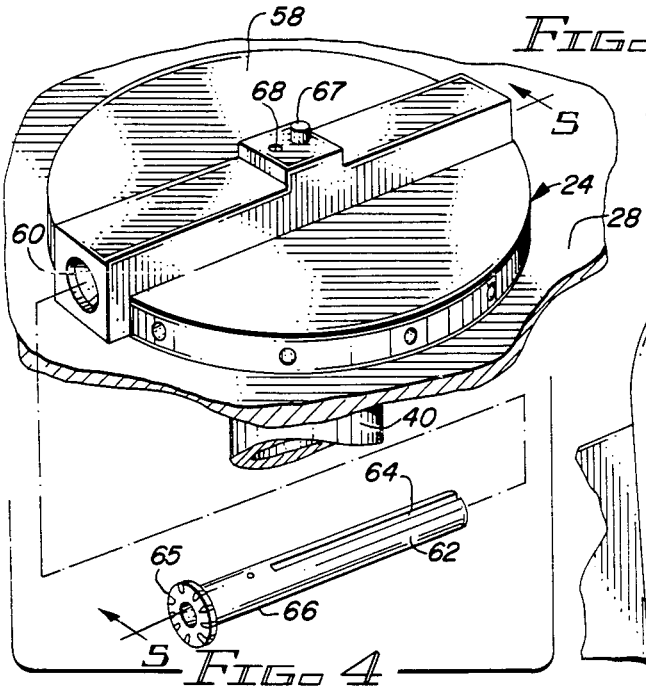
FIG. 4 is an exploded perspective view of the enabling device of the invention mounted on a fragmentary portion of a gas generator.
Figure 5:
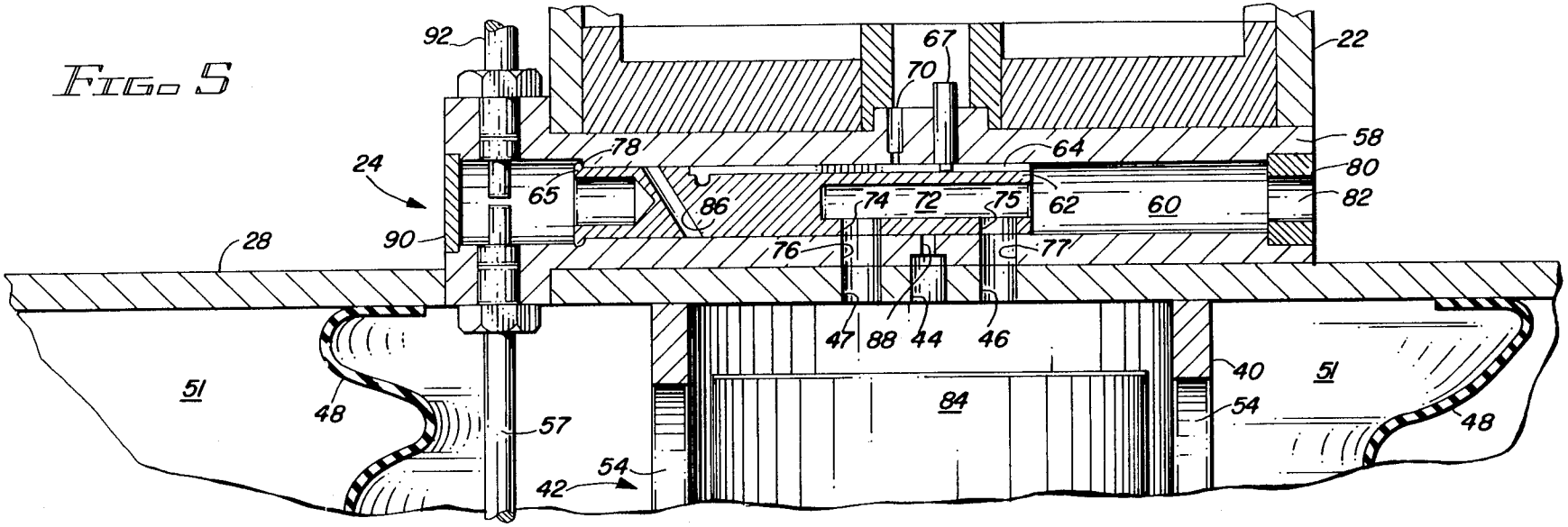
FIG. 5 is an enlarged sectional view taken on line 5—5 of FIG. 4 of the enabling device of the invention in its disabled condition.
Figure 6:
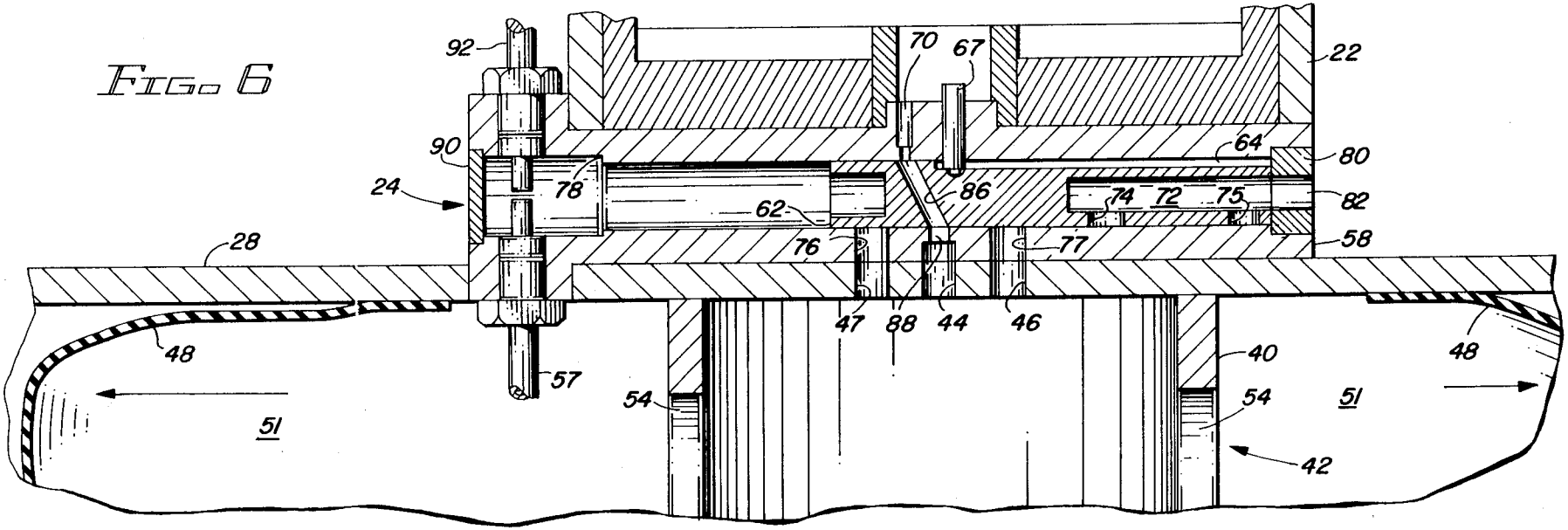
FIG. 6 is a view similar to that of FIG. 5 of the enabling device is in its enabled position.

Enabling device 24 as seen in FIG. 4 has a housing 58, with a bore 60 formed through housing 58. Movable piston, or barrier, 62 is positioned within bore 60. Barrier piston, 62 is provided with a safety vent, longitudinal groove, 64 in its outer surface and a plurality of radial stops 65 which project from the drive end 66 of piston 62. Mounted on housing 58 is detent 67. An opening 68 is formed in housing 58 in which electrically initiated detonator 70 is located as is best seen in FIGS. 5 and 6. Housing 58 is made cylindrical to fit into an end of ECU 22 in the preferred embodiment.

In FIG. 5, enabling device 24 is in its disabled condition, or state, with piston 62 in its disabled position. Safety passage 72 which is formed in piston 62 communicates through safety apertures 74, 75 formed in piston 62 and safety openings 76, 77 formed in housing 58 with the interior of gas generator 42 through safety outlets 46, 47 formed in that portion of bulkhead 28 forming the upper end of gas generator 42. Stops 65 of piston 62 engage shoulder 78 to retain piston 62 in its disabled position until explosive lead 57 is ignited by shaped charge 56 being fired which forces piston 62 into its enabled position. A stop insert 80 is positioned in the end of bore 60 remote from the drive end 66 of piston 62. Stop 80 is provided with a large opening, or safety vent, 82 so that gases from detonator 70 or from pyrotechnic powder grain 84 of gas generator 42, or both, if produced, will be vented out of, or escape from, housing 58 to the ambient environment of enabling device 24 when enabling device 24 is in its disabled state as illustrated in FIG. 5.

In FIG. 6 enabling device 24 is shown in its enabled state, and with membrane 48 forming air bag 51 fully expanded. This condition of air bag 51 will exist essentially immediately after grain 84 of gas generator 42 has been completely consumed, or burned up, in the process of producing the maximum amount of gas that gas generator 42 is capable of producing. Grain 84 is ignited by detonator 70 being fired by an electrical firing signal which is applied to detonator 70 by electronic control unit 22 when piston 62 is in its enabled position as illustrated in FIG. 6. The firing train for grain 84 of gas generator 42 includes detonator 70, transfer lead 86 formed in piston 62 when piston 62 is in its armed position as illustrated in FIG. 6. It should be noted that when enabling device 24 is in its enabled state, safety outlets 46 and 47 of gas generator 42 are closed, or blocked, by piston 62 and safety vent groove 64 is no longer in communication with detonator 70 and therefore does not vent it.

Insert 90 closes the end of bore 60 remote from stop 80. Gas from explosive link 57 when ignited by the cutting network which includes shaped charges 56, provides enough power to drive piston 62 from its disabled position to its enabled position shearing off stops 65 in the process. Stop 80 stops piston 62 in a position in which transfer lead 86 is aligned with detonator 70, output lead 88, and inlet lead 44 of gas generator 42. Detent 67 projects into a recess in groove 64 to maintain, or secure, piston 62 in its enabled position. Detent 67 which projects into groove 64 also prevents piston 62 from rotating in bore 60 particularly when piston 62 is being driven from its disabled to its enabled position by combustion products produced by the ignition of lead 57.

When carrier dispenser 14 is assembled, enabling device 24 is held in its safe position by stops 65 engaging shoulder 78. Thus if detonator 70 is fired accidentally before piston 62 is driven to its enabled position, gases and flames from the detonation of detonator 70 will flow down safety vent groove 64 and flow out of enabling device 24 through bore 60 and opening 82 in stop 80. Any combustion products produced by detonator 70 that might flow through safety outlets 46, 47 into gas generator 42 will not have enough energy or temperature to ignite grain 84. Likewise if grain 84 is accidentally ignited while enabling device 24 is in its disabled condition the gases produced by burning, or ignited grain 84 will flow through safety outlets 46, and 47 safety openings 76, and 77, safety apertures 74, and 76 passage 72, bore 60 and out through opening 82 in stop 80 to the ambient environment surrounding enabling device 24. While membrane 48 will no doubt expand to some extent, if grain 84 is ignited while enabling device 24 is in its disabled state, or condition, the pressure build up within gas generator 42 and bladder 51, for example, will not be sufficient to apply a large enough force to the submunitions 26 to rupture the outer skin 20 of carrier 14 and thus eject, or disperse, the submunitions 26 carried in the munitions bays 30, 31, 32, for example, from carrier 14.

At the time of release of a TMD 10 from an aircraft on which TMD 10 is secured, or carried, a conventional fuze lanyard, which is not illustrated, would be pulled. The extraction of the lanyard begins the arming sequence of the fuzing subsystem of TMD 10 which fuzing subsystem is located in nose section 12 of TMD 10. The electrical connections between nose section 12 and electronic control unit 22 are not illustrated since they are conventional. After an appropriate period of time has elapsed after TMD 10 was dropped, or TMD 10 has reached a predetermined altitude, the fuzing subsystem will initiate the explosive cutting network which includes the shaped charges 56 which cut the outer skin 20 from carrier 14 so that outer envelope 20 will not be present to interfere with the forced dispersal of the submunitions 26, 27 of carrier disperser 14. The cutaway segments of the outer skin 20 are stripped away by aerodynamic forces as the TMD 10 falls. When the cutting network is initiated, explosive link 57 is initiated by shaped charge 56 located in the aft end of carrier 14. The initiation of explosive link 92 by link 57 causes forward enabling device 94 to change from its disabled to its enabled state. Forward enabling device 94 is the structural and functional equivalent of enabling device 24.

When enabling device 24 is in its armed state, or condition, an electrical firing signal produced by ECU 22 applied to detonator 70 will, through the completed firing train, ignite pyrotechnic powder grain 84 of gas generator 42. Grain 84 when ignited produces gas having sufficient power to expand the membranes 48, 49, 50 to force the submunitions 26 in bays 30, 31, 32 laterally from dispense 14, i.e., submunitions 26 will have a velocity component substantially perpendicular to that of longitudinal axis 38 of carrier 14. The velocity of this lateral component of velocity is a function of the rate at which gas is produced by gas generator 42. The operation of enabling device 94 in dispersing submunitions 27 from forward bay 37 of dispenser 14 is substantially the same as that of enabling device 24. The structure and function of the generator 42' and flexible membrane 48' are likewise similar to that of their counterparts.

While the principles of the invention have now been made clear in the illustrated embodiment there will be immediately obvious to those skilled in the art many modifications of structure arrangements, proportions, the elements, materials, and components used in the practice of the invention, and otherwise which are particularly adapted for specific environments and operations requirements without departing from those principles. The appended claims are therefore intended to cover and embrace any such modifications within the limits only of the true spirit and scope of the invention.

We claim:

1. An enabling device 24 for a pyrotechnic gas generator 42, said device having two states, a disabled state and an enabled state, said device comprising:

a housing 58;

detonator means 70 mounted in the housing 58 for producing a detonation responsive to a fire signal;

said device 24 in its disabled state having means for venting 64, 60, 82 the products of the detonation of the detonator 70 to the environment exterior of the housing 58, and means for venting 46, 47, 76, 77, 74, 75, 72, 60 and 82 gases produced by a gas generator 42, to the environment exterior of the housing 58;

said device 24 in its enabled state including means forming an uninterrupted firing train 86, 88, 44, between the detonator means 70 and gas generator 42 for initiating the release of gas from the gas generator 42; and means responsive to a signal 57 for causing the enabling device 24 to change from its disabled state to its enabled state.

2. An enabling device 24 as defined in claim 1, in which gas generator 42 has a pyrotechnic material 84 located in it, and in which the pyrotechnic material 84 is ignited by the detonator means 70 being detonated when the enabling device 24 is in its enabled state.

3. An enabling device 24 as defined in claim 2 in which the housing 58 is provided with a bore 60 formed through housing 58; a movable piston 62 positioned within bore 60, said piston having a disabled position and an enabled position; stop means on the piston for maintaining the piston 62 in its disabled position, and explosive means 57 for driving piston 62 from its disabled position to its enabled position.

4. An enabling device 24 as defined in claim 3 in which the explosive means is an explosive lead 57.

5. An enabling device 24 as defined in claim 4 in which the means for venting the products of the detonation of the detonator 70 to the environment exterior of the housing 58 when piston 62 is in its disabled position includes a longitudinal groove 64 formed in the outer surface of the piston 62 and the bore 60.

6. An enabling device 24 as defined in claim 5 in which the means for venting gas produced by the gas generator 42 when the piston 62 is in its disabled state includes aligned apertures 46, 77, 75 47, 76, 74 in the gas generator 42, the housing 58, and the piston 62.

7. An enabling device 24 as defined in claim 6 in which the uninterrupted firing train between the detonator means 70 and the pyrotechnic material 84 of the gas generator 42 includes a transfer lead 86 formed in the piston 62, an outlet lead 88 formed in the housing 58, and an inlet lead 44 of the gas generator 42.

8. An enabling device 24 for a gas generator 42, said device 24 having a disabled state and an enabled state comprising:

a housing 58;

a detonator 70 mounted in said housing 58, said detonator being detonatable by a firing signal;

a gas generator 42 mounted on said housing 58;

said device 24 in its disabled state having means forming a first safety passage 64, 60, 82 for permitting products produced when the detonator 70 detonates to flow out of the housing 58, and means forming a second safety passage 46, 47, 76, 77, 74, 75, 60 and 82 for permitting gas produced by the gas generator 42 to flow out of the housing 58;

said device 24 in its enabled state including means forming a firing train 86, 88, 44 from the detonator 70 to the gas generator 42 for causing the gas generator 42 to begin producing gas when the detonator is detonated; and means for closing 62 said safety passages 46, 47, 76, 77, so the gas produced by the gas generator 42 can not flow out of the housing 58 through passages 46, 47, 76, 77;

means for causing the device 24 to change from its disabled state to its enabled state in response to an enabling signal; and means for applying a firing signal 22 to the detonator 70.

9. An enabling device 24 as defined in claim 8 in which the firing signal is an electrical signal produced by an electronic control unit 22.

10. An enabling device 24 as defined in claim 9 in which the gas generator 42 includes a hollow cylinder 40, a plurality of opening 54 formed in hollow cylinder 40 and a pyrotechnic material 84 located in cylinder 40.

11. An enabling device 24 as defined in claim 10 in which the housing 58 is provided with a bore 60 formed through housing 58, a movable piston 62 positioned within bore 60, said piston 62 having a disabled position and an enabled position corresponding to the two states of the enabling device, stop means 65 formed at one end of the piston and shoulder means 78 formed in the housing 58 to locate the piston 62 in its disabled state and restrain it in that position, and explosive means 57 for shearing off the stop means 65 and for driving the piston 62 from its disabled to its enabled position in response to the enabling signal being applied thereto.

12. An enabling device 24 as defined in claim 11 in which the explosive means is an explosive lead 57.

13. A forced dispersal munitions dispenser 14 comprising:

a nose section 12;

a cylindrical submunitions carrier 14 having an outer envelope 20;

a tail section 16;

control means 22; and an enabling device 24, said enabling device including:

a housing 58;

a bore 60, an output lead 88, safety opening 76, 77, and a safety vent 82 formed in the housing 58;

a piston 62 located in said bore 60, a safety passage 72, a safety aperture 76, 77 and a transfer lead 86 formed in the piston 60, a safety groove 64 formed on the outer surface of the piston 62, said piston 62 having two positions, a disabled position and an enabled position;

detonator means 70 mounted on said housing 58 for detonating in response to a fire signal being applied thereto by the control unit 22;

a gas generator 42 containing a pyrotechnic powder grain 84; said gas generator 42 having a safety outlet 46, 47 and an inlet lead 44, said gas generator being mounted on said housing 58;

means forming submunitions storage bays 30, 31, 32, in the submunitions carrier 14 around the gas generator 42, for storing submunitions 26, 27;

means forming an inflatable gas bag 51, 52, 53 in each storage bay 30, 31, 32, 37 around the gas generator 42;

means forming a passage 54 in the gas generator 42 to permit gas produced by the gas generator 42 to inflate each gas bag 51, 52, 53;

the safety groove 64 of the piston 62 and bore 60 providing a path for combustion products produced by detonating the detonator 70 to the ambient environment of housing 58, and the safety passage 72, safety opening 76, 77 safety apertures 74, 75 and the bore 60 providing a path for gas produced by the gas generator 42 to escape to the ambient environment of the housing 58 when the piston 62 is in its disabled postion;

means for moving 57 the piston 62 from its disabled position to its enabled position;

the detonator 70, transfer lead 86, outlet lead 88, and input lead 44 forming a firing train for initiating ignition of the pyrotechnic grain 84 of the gas generator 42 to produce gas when the detonator 70 is initiated by a firing signal after the piston 62 is moved to its enabled position; and said detonator means 70 igniting the pyrotechnic grain 84 when the detonator means 70 is detonated and piston 62 is in its enabled position.

14. A forced dispersal munitions dispenser 14 as defined in claim 13 in which the detonator means 70 is electrically initiated by an electrical fire signal produced by the control means 22.

15. A forced dispersal munitions dispenser 14 as defined in claim 14 which further includes means for removing 56 the outer envelope 20 of carrier 14.

16. A forced dispersal munitions dispenser 14 as defined in claim 15 in which the means for removing the outer envelope 20 of carrier 14 is an explosive cutting network 56 which is initiated by an initiating signal produced by the control means 22 prior to the piston 62 of the enabling device 24 being moved from its disabled position to its enabled position.

17. A forced dispersal munition dispenser 14 as defined in claim 16 in which the explosive cutting network 56 includes explosive shaped charges 56.

18. A forced dispersal munitions dispenser 14 as defined in claim 17 in which the means for moving the piston 62 from its disabled position to its enabled position is an explosive link 57 which is initiated by the explosive shaped charges 56 of the cutting network 56 so that the piston 62 of the enabling device 24 is not moved from its disabled position to its enabled position until after the outer envelope 20 is severed from carrier 14.

19. A forced dispersal munitions dispenser 14 as defined in claim 18 in which stop means 65, 78 are provided on the piston 62 and the housing 58 of the enabling device 24 to retain the piston 62 in its disabled position until the explosive link 57 is initiated by the explosive shaped charges of the cutting network 56.

20. A forced dispersal munitions dispenser 14 as defined in claim 19 in which detent means 67 are mounted on the housing 58 for preventing piston 62 from rotating in bore 60 when piston 62 is moved from its disabled position to its enabled position and for securing piston 62 in its enabled position.

* * * * *